US007712716B2

(12) United States Patent
Riblet

(10) Patent No.: US 7,712,716 B2
(45) Date of Patent: May 11, 2010

(54) ADJUSTABLE HEIGHT SCAFFOLD COMBINATION

(76) Inventor: Henry J. Riblet, 52 Pine Needle La. P.O. Box 232, Melvin Village, NH (US) 03850

( * ) Notice: Subject to any disclaimer, the term of this patent is extended or adjusted under 35 U.S.C. 154(b) by 286 days.

(21) Appl. No.: 11/612,018

(22) Filed: Dec. 18, 2006

(65) Prior Publication Data

US 2007/0145215 A1 Jun. 28, 2007

Related U.S. Application Data

(63) Continuation of application No. 11/507,944, filed on Aug. 22, 2006, now abandoned, which is a continuation-in-part of application No. 09/955,467, filed on Sep. 17, 2001, now Pat. No. 7,152,835, which is a continuation-in-part of application No. 09/477,660, filed on Jan. 5, 2000, now abandoned.

(51) Int. Cl.
*A47G 29/02* (2006.01)

(52) U.S. Cl. ..... 248/246; 248/248; 248/235

(58) Field of Classification Search ..... 248/246, 248/248, 235, 243; 182/136, 132, 145; 254/106
See application file for complete search history.

(56) References Cited

U.S. PATENT DOCUMENTS

| | | | | | |
|---|---|---|---|---|---|
| 878,455 | A * | 2/1908 | Carter | ..... | 248/246 |
| 2,737,363 | A * | 3/1956 | Horst | ..... | 248/354.1 |
| 3,473,774 | A * | 10/1969 | Riblet | ..... | 248/246 |
| 3,970,277 | A * | 7/1976 | Riblet | ..... | 248/246 |
| 4,103,856 | A * | 8/1978 | Riblet | ..... | 248/246 |
| 6,273,381 | B1 * | 8/2001 | Riblet | ..... | 248/248 |

* cited by examiner

*Primary Examiner*—Anita M King
(74) *Attorney, Agent, or Firm*—Bourque and Associates, PA

(57) ABSTRACT

A clamp for mounting an angle bracket on a tubular upright having a side member, an outer jaw and an inner jaw coupled to the side member, and coupling means permitting the side member to pivot relative to the angle bracket about a fixed or non-fixed pivot axis. The inner and outer jaws preferably feature contact surfaces that are portions of circular, cylindrical outer surfaces, but in any case are shaped to contact the cylindrical outer surface of the upright. The clamp is attached to the angle bracket and the jaws are pivotally mounted in the clamp so that the jaws have the necessary number of degrees of freedom with respect to the side member to permit them to contact the upright on extended areas.

19 Claims, 8 Drawing Sheets

ADJUSTABLE HEIGHT SCAFFOLD COMBINATION

CROSS-REFERENCE TO RELATED APPLICATIONS

This application is a continuation of U.S. patent application Ser. No. 11/507,944 filed on Aug. 22, 2006 now abandoned which is a continuation-in-part of U.S. patent application Ser. No. 09/955,467, filed Sep. 17, 2001 now U.S. Pat. No. 7,152,835 and titled IMPROVED BRACKET ASSEMBLY LOCK, which is a continuation-in-part of U.S. patent application Ser. No. 09/477,660 filed Jan. 5, 2000, now abandoned all of which are hereby incorporated by reference.

TECHNICAL FIELD

The present invention relates to scaffolds and more particularly, relates to scaffold bracket assemblies.

BACKGROUND INFORMATION

Adjustable height scaffolds are well known in the art and typically comprise four main elements: an upright, a bracket assembly for supporting a work platform on the upright, a jack or block and tackle for raising and lowering the bracket assembly on the upright, and a cage for holding the upper end of the upright in place.

Two types of adjustable height scaffolds, which are designed with uprights, constructed of wood or rubber-backed aluminum are well known and widely used. The load bearing surfaces of these uprights are elastically deformable and hence, when loaded, have cross sections that change, i.e., the jaws of the clamp of these scaffolds indent said surfaces temporarily.

An example of an adjustable height scaffold, which is designed for use with a wooden upright is U.S. Pat. No. 2,216,912 to Hoitsma. The Hoitsma patent discloses an angle bracket to which a jack is coupled, and is commonly referred to as a "pumpjack". Another example of an adjustable height scaffold that is designed for use on an upright constructed of wood is U.S. Pat. No. 2,342,427 to Riblet. The Riblet patent discloses a bracket assembly which is raised and lowered by block and tackle This adjustable height scaffold has been referred to as the "painter's pole".

Examples of adjustable height scaffolds, designed for use with aluminum uprights to which a rubber strap has been riveted, include U.S. Pat. No. 4,597,471 to Anderson and U.S. Pat. No. 5,259,478 to Berish et al. It should be noted that the Anderson patent and the Berish patent both use the jaws of the pumpjack mechanism disclosed in the Hoitsma patent. It should also be noted that the jaws of the painter's pole bracket disclosed in Riblet '427 have been adapted for use on rubber-backed aluminum uprights.

U.S. Pat. No. 878,455 to Carter, U.S. Pat. No. 2,801,851 to Meek and U.S. Pat. No. 4,308,934 to Jackson disclose related bracket assemblies. The bracket assemblies disclosed in Carter, Meek and Jackson differ from the bracket assemblies noted above in that the inner jaw of their locks is formed from an extended surface of the associated angle bracket, i.e., they do not pivot with respect to the associated angle bracket. The contact points of said jaws with the upright depend on the straightness of the upright and may be too far apart to provide sufficient friction to support the vertical load. Consequently, they require an outer jaw, in order to supply the vertical force needed to support the load, which indents in some way the upright and so changes, temporarily at least, its cross section.

All of the prior art patents use uprights whose cross sections are altered locally when loaded. The present invention, in contrast, teaches how the molecular, friction force between the jaws of the clamp and the upright may safely support a load without temporarily altering the upright's cross section.

In the Pump Jack, a spring is required to initiate contact of the jaws of the clamp with the upright. In the painter's pole, however, the clamp is coupled to the angle bracket in such a manner that a load placed on the angle bracket exerts a turning moment on the clamp which initiates and maintains contact of the jaws of the clamp with the upright so long as the width of the upright exceeds the design width. A clamp with this property is called a "load activated clamp".

The outer, load supporting jaw of the pumpjack has a square cross section and is fixed in position in the side members of the clamp to insure that the corner of the square jaw bites into the wooden or rubber surface of the upright when the clamp is supporting a load. When the load is being lowered, however, the clamp is rotated to a horizontal position by the worker. Rotating the clamp to a horizontal position moves a face of the square jaw of the pumpjack so that it is more parallel to the upright. This reduces the vertical, supporting force on the jaw and permits the lowering of the scaffold. With the clamp in a horizontal position, so that a face of the jaw is nearly parallel to the upright, the bracket assembly is lowered.

The jaws of the lock of a painter's pole have smooth, cylindrical surfaces that indent the surface of a wooden upright along the points of a shallow cylinder. As we have seen, the outer jaw of a pumpjack has an edge which bites into the surface of an upright along the corner of a square. Because of the elastically, deformable nature of the wood or rubber used in these uprights, the jaws used in the clamps of said adjustable height scaffolds do not damage the uprights. They do, however, alter the cross section of the upright temporarily. Jaws of this type will be referred to as "edged" jaws because they would contact a hard, flat surface on a single line.

SUMMARY

In this application, the word "pivot" is used in a more general sense than its use in prior art adjustable height scaffolds as typical rotation about an axis that is, the term "pivot" does not mean rotation about a single axis but rather, the ability of one part to move relative or vis-à-vis another part. In order that a jaw of the clamp grip the upright on an extended area firmly, the clamp must pivot approximately horizontally in going from an unlocked position to a locked position. Then, if the contacting surfaces of the upright and at least one of the jaws are portions of cylinders, said jaw pivots approximately about a horizontal axis, and, depending on the accuracy with which the parts are made, slides approximately horizontally and twists about an axis approximately perpendicular to the axis of the upright so that said jaw contacts the upright on an extended area. In this specification and in the claims, the parts which are pivoting with respect to each other may be connected by means which permit relative motion of the clamp jaws with respect to the side members of the clamp with the sufficient number of degrees of freedom needed, to permit the jaws of the clamp to properly contact a cylindrical surface of the upright.

According to one embodiment, the present invention features a load activated clamp for use in mounting an angle bracket on an upright. The load activated clamp features at least one side member, a fulcrum bar coupled to the side member and to the angle bracket such that the side member pivots relative to the angle bracket about the fulcrum bar, and an outer jaw and an inner jaw coupled to the side member.

One of the jaws pivots relative to the side member and includes a surface, for contacting an extended area of the upright, which extends over a portion of a circular cylinder whose axis parallels the axis of the upright. Alternatively, both the inner and the outer jaws pivot relative to the side member and include surfaces, for contacting extended areas of the upright, which extend over portions of circular cylinders whose axes parallel the axis of the upright.

According to another embodiment, the present invention features a bracket kit. The bracket kit includes an upright and a bracket assembly. The upright features at least a contact surface having the surface of a portion of a cylinder whose axis runs along the longitudinal axis of the upright and whose cross-section may be linear, circular or any one of many possible curves. The bracket assembly features an angle bracket, a lower bracket arm, and a load activated clamp. The lower bracket arm is adapted to be secured to the angle bracket and is sized and shaped to mate with at least one surface of the upright. The load activated clamp includes at least one side member, a fulcrum bar coupled to the side member and to the angle bracket such that the side member is adapted to pivot relative to the angle bracket about the fulcrum bar, and an outer jaw and an inner jaw coupled to the side member. At least one of the inner and outer jaws pivots relative to the side member and includes a surface, for contacting the upright, which extends over a portion of a cylinder whose axis parallels the axis of the upright.

According to another embodiment, the pivoting of the side member relative to the outer jaw does not employ a cross bar to define a pivot axis, fixed in position, in both the side member and the outer jaw. In this case, a well defined pivot axis exits when no cross bar defining it is present, but for the pivoting of the inner jaw with respect to the side member and the pivoting of the side member with respect to the angle bracket, no well defined pivot axis exists.

According to yet another embodiment, the present invention features a clamp for mounting an angle bracket on an upright. The clamp includes a frame having means for pivoting and a jaw coupled to the frame. The jaw includes a contact surface which may be planar or cylindrical in shape depending on the nature of the upright surface that it must contact over an extended area.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the following claims.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
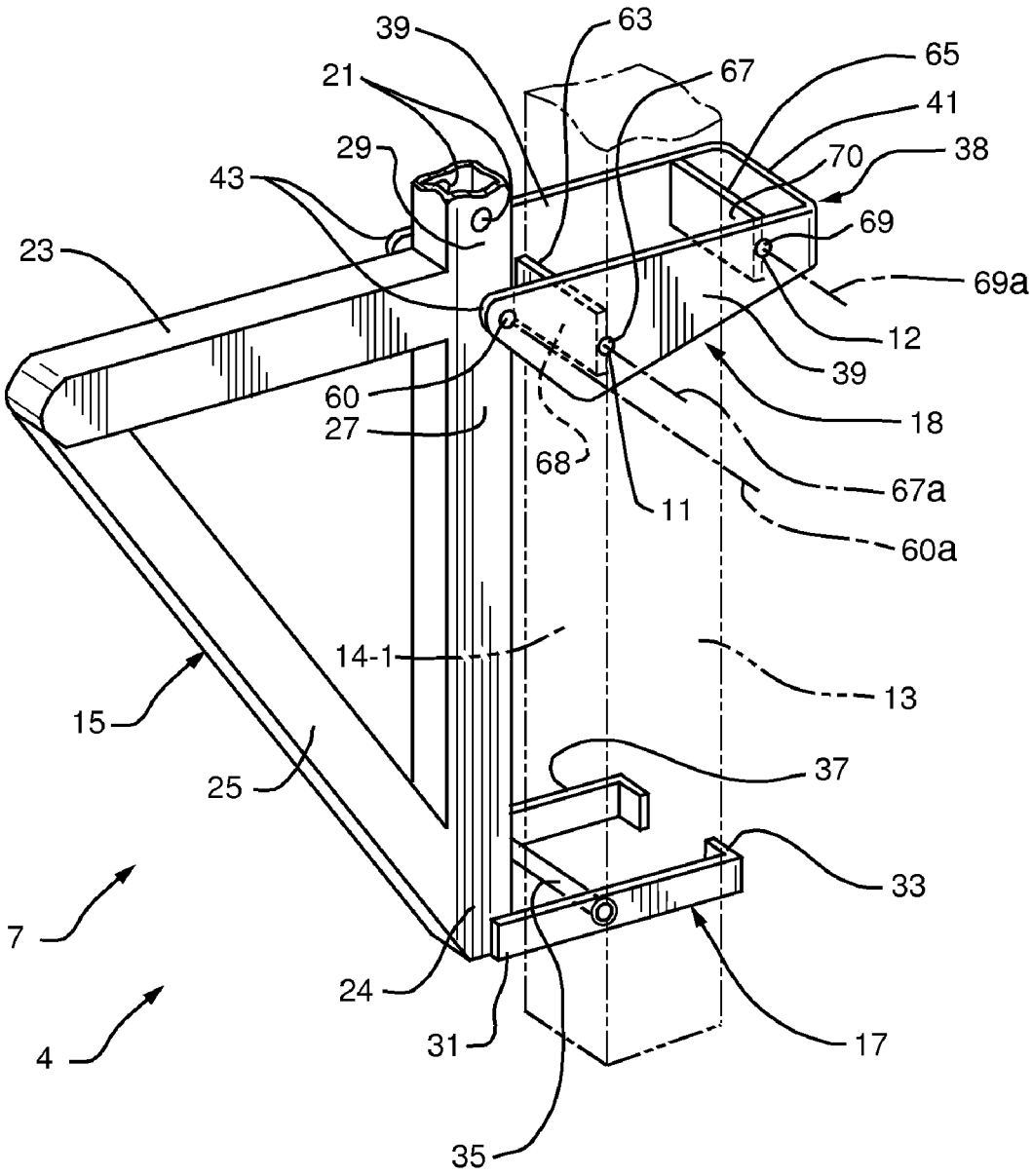
FIG. 1 is a perspective view of an embodiment of a combination of bracket assembly and an upright according to one embodiment of the teachings of the present invention.

Referring now to FIG. 1, there is shown a perspective view of an embodiment of the combination 4 of bracket assembly 7 and upright 13 constructed according to one embodiment of the present invention. Bracket assembly 7 is shown mounted on upright 13, which may be constructed of a non-elastically, deformable material, such as aluminum or plastic, and has a constant cross section which is dimensioned so that combination 4 will support a heavy load.

Bracket assembly 7 comprises an angle bracket 15, a lower bracket arm 17 and a load activated clamp 18, pivotally attached to angle bracket 15 by fulcrum bar 60. Bracket arm 17 and load activated clamp 18 cooperate to mount angle bracket 15 onto upright 13. In this manner, a pair of bracket assemblies 7 in combination with uprights 13 can be used to create a scaffold. Specifically, with a pair of bracket assemblies 7 each mounted onto its upright 13, a scaffold is created by placing a plank across each angle bracket of the pair of bracket assemblies 7.

It is to be understood that angle bracket 15, which comprises a vertical leg 27, diagonal leg 25 and a horizontal leg 23, does not serve as a principle feature of the present invention. Accordingly, angle bracket 15 could be replaced with alternative types of angle brackets without departing from the spirit of the present invention. As an example, angle bracket 15 could be modified in such a manner that the inner end of horizontal leg 23 and the vertical leg 27 are welded together, without a need for diagonal leg 25.

Lower bracket arm 17 comprises a U-shaped band 37 having a closed end 31 and an open end 33. Lower bracket arm 17 is coupled to angle bracket 15 by welding closed end 31 of band 37 onto lower end 24 of vertical leg 27. Positioned as such, the placement of a vertical load on horizontal leg 23 of angle bracket 15 will force cross bar 35 against inner, load bearing surface 14-1 of upright 13.

It is to be understood that neither the particular construction of lower bracket arm 17 nor the means of its attachment to vertical leg 27 is a principal feature of the present invention.

Vertical leg 27 includes a pair of apertures 21. A conventional block and tackle or a jacking device (neither shown) can be attached to angle bracket 15 through apertures 21 to enable bracket assembly 7 to be raised and lowered on upright 13.

Load activated clamp 18 comprises a generally U-shaped band 38 having a pair of spaced apart, parallel side members 39, with a closed end 41 and a pair of free ends 43 and inner jaw 63 and outer jaw 65. Said inner and outer jaws and said side members enclose upright 13.

Side members 39 of load activated clamp 18 are coupled to angle bracket 15 near upper region 29 of vertical leg 27 by generally cylindrical fulcrum bar 60. Specifically, fulcrum bar 60 extends through apertures in side members 39 and vertical leg 27 and provides a fixed axis 60*a* about which load activated clamp 18 can pivot relative to angle bracket 15. As shown in FIG. 1, side members 39 include a first pair of openings 11 and a second pair of openings 12, shaped to accept cross bars 68 and 70 on which jaws 63 and 65 are mounted to permit the independent pivoting of jaws 63 and 65 about pivot axes 67*a* and 69*a*. Since pivot axis 67*a* is disposed beneath the plane defined by fulcrum pivot axis 60*a* and pivot axis 69*a*, clamp 18 is load activated.

It should be noted that fulcrum bar 60 could be replaced with any means which attaches clamp 18 directly to angle bracket 15 and permits clamp 18 to pivot with respect to angle bracket 15 about fulcrum axis 60*a*.

Figure 4:
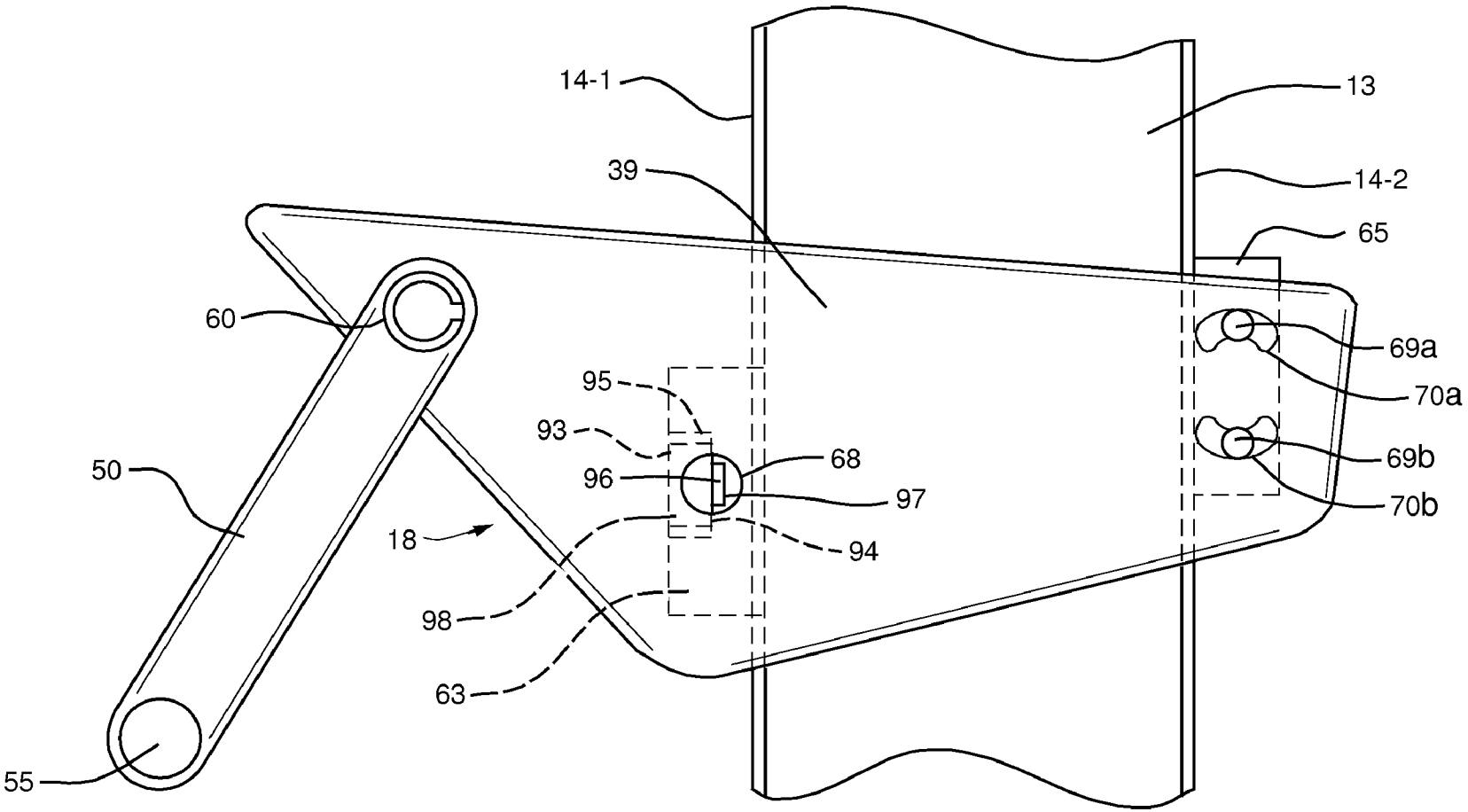
FIG. 4 is a cross section side view of the clamp and upright of FIG. 2 in which the pivot axis relating the outer jaw to the side member of the clamp is not defined by a cross bar while the cross bar, supporting the inner jaw, pivots about a pivot axis relative to the side member but neither slides nor twists relative to the side member, and the side member of the clamp pivots relative to the angle bracket without a defined pivot axis.

The clamp in accordance with the present invention which is connected to the angle bracket by link 50 as shown in FIG. 4 'pivots' with respect to the angle bracket without the existence of a pivot axis, that is fixed in position in either structures. Any, useful, relative motion between the clamp and the angle bracket will be referred to herein as 'pivoting'. The clamp in the pumpjack pivots with respect to the angle bracket. The word "pivot" will include this broader meaning in describing the relative motions of the side members with the jaws of the clamp. The jaws may "pivot" relative to the side members whether or not a single "pivot axis" exists.

It should be noted that side members 39 are not limited to the particular size and shape shown in FIG. 1. Rather, side members 39 could be replaced with a different sized and shaped structure that permits the pivoting of said structure with respect to angle bracket 15.

It should also be noted that the particular shape and construction of inner jaw 63 and outer jaw 65, which may differ from each other, in combination with a suitable upright 13, create functional advantages and accordingly serve as a principal feature of the present invention. In particular, as will be described further in detail below, outer jaw 65 and inner jaw 63, individually or as a pair, function as Extended Area Contacting (EAC) jaws. An EAC jaw, as pictured in FIG. 1, is distinguished from the edged jaws of the prior art in that it has a cylindrical surface which, when placed in the proper orientation on an upright 13 with a cylindrical, outer surface of the same shape, will contact said outer surface at points randomly distributed over an extended area. The minimum, cylindrical rectangle, which includes the random points of contact between said EAC jaw and the cylindrical, non-elastically deformable surface of a suitable upright against which it is pressed, has a width, W, and a height, H, with H greater than zero.

In order to permit clamp 18 to move from a position where the clamp grips upright 13 to a position where the clamp does not grip the upright 13, the clamp pivots with respect to angle bracket 15 about fulcrum pivot axis 60*a*. Moreover, inner EAC jaw 63 and outer EAC jaw 65 both pivot independently in order to permit said EAC jaws to contact said upright on extended areas.

Inner EAC jaw 63 is provided with pins 67 that project through openings 11, 12 in side member 39. The pins are sized and shaped to fit within suitably, dimensioned openings 11, 12 in such a manner as to enable inner jaw 63 to pivot independently about inner jaw pivot axis 67*a* relative to side members 39 to slide horizontally relative to side members 39 and to twist independently about an axis perpendicular to the axis of the upright 13 relative to side members 39 and so permit the axis of the contacting cylindrical surface of said jaw to coincide with the axis of the contacting cylindrical surface of the upright 13. Like means are provided for mounting similar, outer EAC jaw 65, with three degrees of freedom, in side members 39. There are many structures that would provide the degrees of freedom achieved in FIG. 2. Pins 69 could be the ends of crossbars, passing through elongated holes 12 in outer EAC jaw 65.

Because the principle feature of the present invention pertains to load activated clamp 18 and more particularly, to inner, EAC jaw 63 and outer, EAC jaw 65 in combination with upright 13, it is to be understood that bracket assembly 7 could be modified without departing from the spirit of the present invention. For example, angle bracket clamp 18 need not be load activated: pivot axes, 60*a*, 67*a* and 69*a* could coplanar. The location of bracket clamp 18 and bracket arm 17 could be interchanged and bracket clamp 18 could be attached by means of a link to angle bracket 15 at a point between upper and lower bracket arms as in Hoitsma '912 and Anderson '471. Only one EAC jaw 65 may be required if the coefficient of friction between the EAC jaw 65 and the upright 13 and the horizontal force exerted on said upright 13 by said jaw 65, in combination, are sufficient to support the load. This would be the situation for a clamp in the bracket assembly of Anderson '471, where the horizontal force on the outer jaw is much greater than that on the inner jaw.

Figure 2:
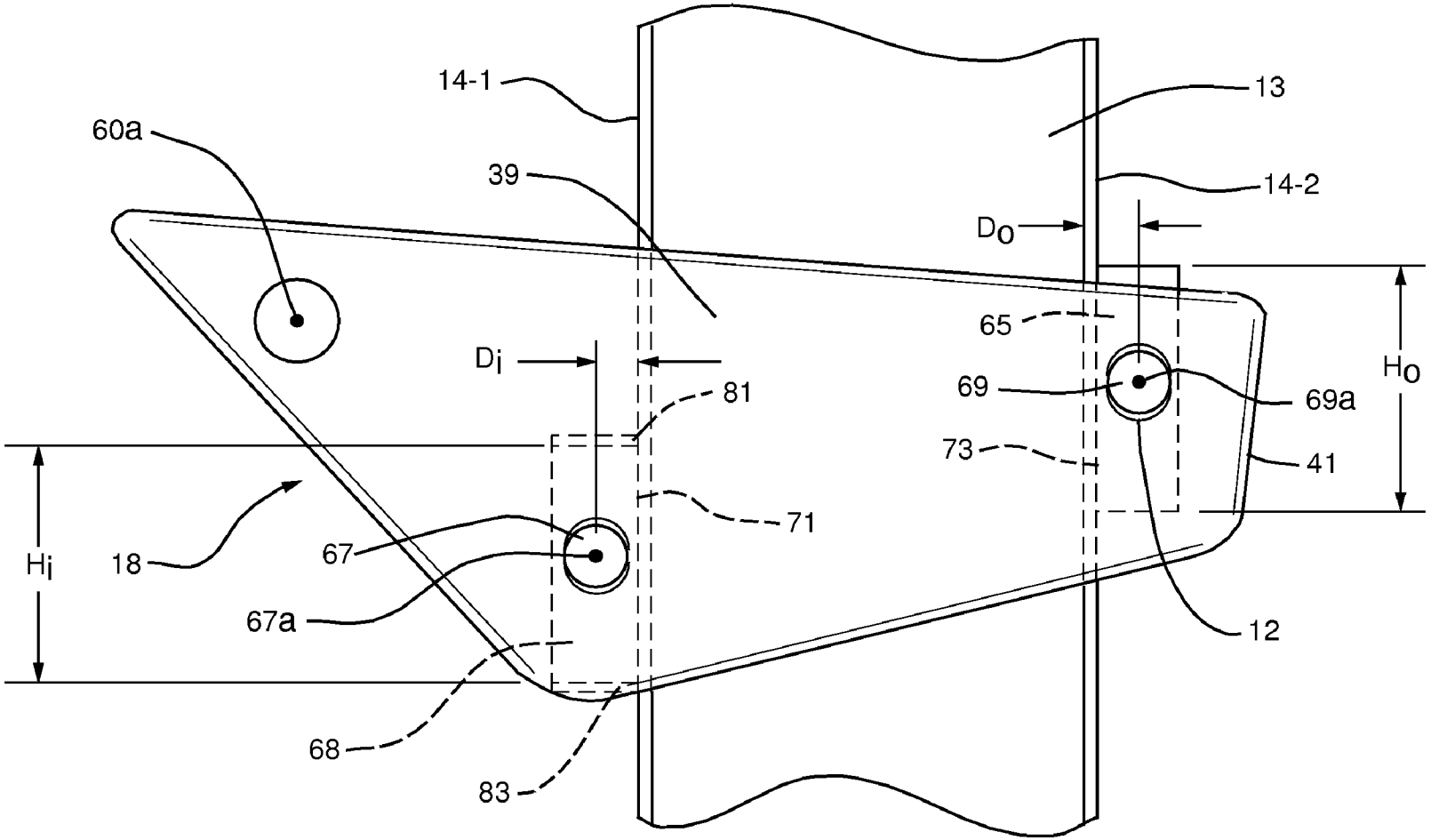
FIG. 2 is an enlarged side view of the load activated clamp shown in FIG. 1, the clamp being shown in a clamped position on a circular cylindrical upright of width slightly wider than the design width.
Figure 3:
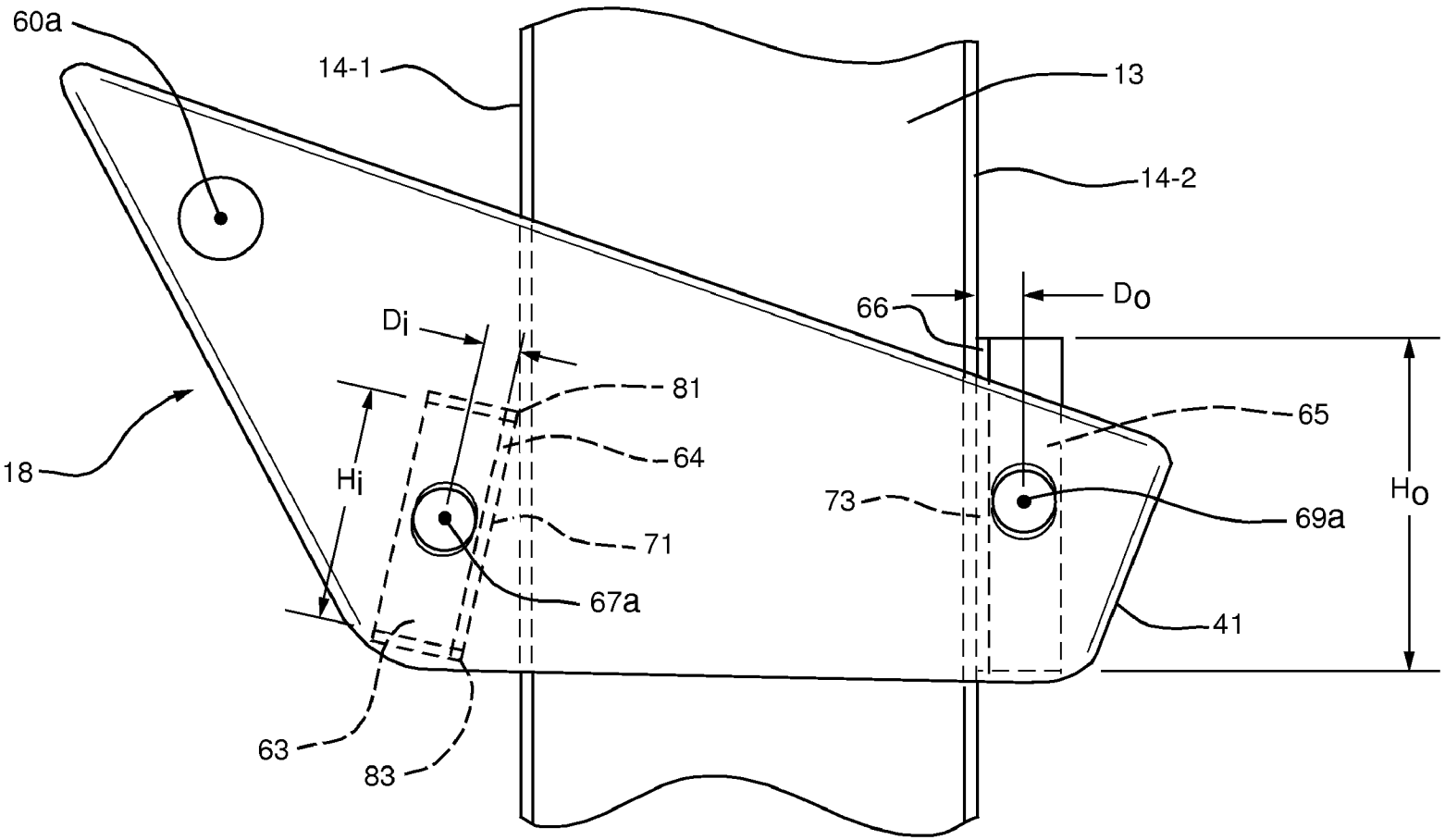
FIG. 3 is an enlarged side view of the load activated clamp shown in FIG. 1, the clamp being shown rotated in the clockwise direction so that the clamp is disposed in an unclamped position on the upright.

Referring now to FIGS. 2 and 3, outer EAC jaw 65 is an elongated member which may be rectangular in the lateral cross-section. Outer EAC jaw 65 comprises a surface 73 that contacts outer, circular cylindrical surface 14-2 of upright 13 on an extended area of height, Ho. Similarly inner EAC jaw 63 contacts inner circular cylindrical surface 14-1 on an extended area of height, Hi. Axis space, Di, is defined as the distance from inner jaw pivot axis 67*a* to inner jaw contact surface 71. Axis space Do is defined similarly for pivot axis 69*a* and outer jaw contact surface 73.

Inner and outer EAC jaws 63, 65 comprise longitudinal holes (not shown) running throughout their length in which crossbars are fixed, whose terminals, 67 and 69 project through vertically elongated apertures 11, 12. Said jaws 63, 65 and said apertures 11, 12 are dimensioned so that said jaws 63, 65 may, independently, slide horizontally and twist vertically with respect to side members 39 of clamp 18.

Since inner EAC jaw 63 and outer EAC jaw 65 pivot independently with respect to side members 39 about respective pivot axes 67*a* and 69*a* and may move laterally as well as twist vertically within said side members and since side members 39 pivot about fulcrum pivot axis 60*a*, inner EAC jaw 63 and outer EAC jaw 65 will, when angle bracket 15 is loaded, contact circular, cylindrical shaped inner surface 14-1 and circular, cylindrical shaped outer surface 14-2, respectively, of upright 13 on extended areas. Thus, if the horizontal forces which jaws 63 and 65 exert on upright 13, when angle bracket 15 is loaded, provide sufficient, vertical force, which depends only on the friction between said jaws and said upright, to support bracket assembly 7, they can be distributed over sufficient area of upright 13, to prevent damage to said upright.

Providing this extended area of contact between said jaws and said upright is a principal object of the present invention. As can be appreciated, the edged jaws of prior art locks would contact a metal or plastic upright on a one-dimensional line and not on a two-dimensional area.

It should be noted that any configuration which permits EAC jaws 63, 65 to pivot independently about their respective pivot axes 67*a*, 69*a* in side members 39 and contact upright 13 over an extended area would be in the spirit of the present invention.

FIG. 2 shows a side view of load activated clamp 18 mounted on upright 13. It should be noted that load activated clamp 18 and upright 13 are dimensioned so that outer jaw pivot axis 69*a* lies below a horizontal plane passing through fulcrum pivot axis 60*a*. The minimum width of the upright, in combination with the bracket assembly, which satisfies this condition will be referred to as the design width. In addition, clamp 18 is dimensioned so that inner jaw pivot axis 67*a* lies below the plane containing fulcrum pivot axis 60*a* and outer jaw pivot axis 69*a* and accordingly is load activated.

As shown in FIG. 3, when load activated clamp 18 is rotated clockwise, the horizontal distance between inner jaw pivot axis 67*a* and outer jaw pivot axis 69*a* increases. As a result, as load activated clamp 18 is rotated clockwise, the horizontal force on the fulcrum axis 60*a* resulting from a vertical load on the angle bracket 15 moves contact surface 71 of inner jaw 63 so that said contact surface no longer contacts inner surface 14-1 of upright 13 over an extended area. In fact, there may be no contact. It is also clear that the ratio between Hi, and Di, must be large enough so that the upper and lower edges of inner EAC jaw 63, even if provided with radii 81, 83, as shown in FIGS. 2 and 3, do not gall or mar inner surface 14-1 of said upright 13 or even jam and prevent the desired up or down movement of the bracket assembly on the upright 13. Clearly then, an extended area of contact between inner EAC jaw 63 and inner surface 14-1 of said upright 13 serves two essential purposes in minimizing damage to said upright 13.

FIG. 4 helps illustrate the defined "pivot means" and illustrates how the pivot axes of FIGS. 2 and 3 are not essential to this invention. In FIG. 4, crossbar 69 passing through outer jaw 65 is replaced by two cross bars 69*a* and 69*b*, passing through longitudinal holes (not shown) in said jaw 65, projecting through two arcuate slots 70*a* and 70*b*. If said arcuate slots have a common center, this center then serves as the pivot axis of outer jaw 65. Outer jaw 65 pivots with respect to side members 39 without the existence of a pivot member, i.e., without a fixed pivot means. The inner jaw 63 includes cross bar 93 having pins, projecting through circular openings 68, on each end of the rectangular section 98 whose planar surface 94 contacts the wider base of the rectangular groove 95, in the EAC jaw 63. A groove centrally located in the base of rectangular groove 95 is dimensioned so that a circular pin 96 on the center of planar surface 94 permits inner jaw 63 to twist and slide relative to cross bar 93. Strap 50 in FIG. 4 pivotally connects load activated lock 18 to an angle bracket (not shown) by means of cross bar 55 and fulcrum bar 60 with no defined pivot axis.

Figure 5:
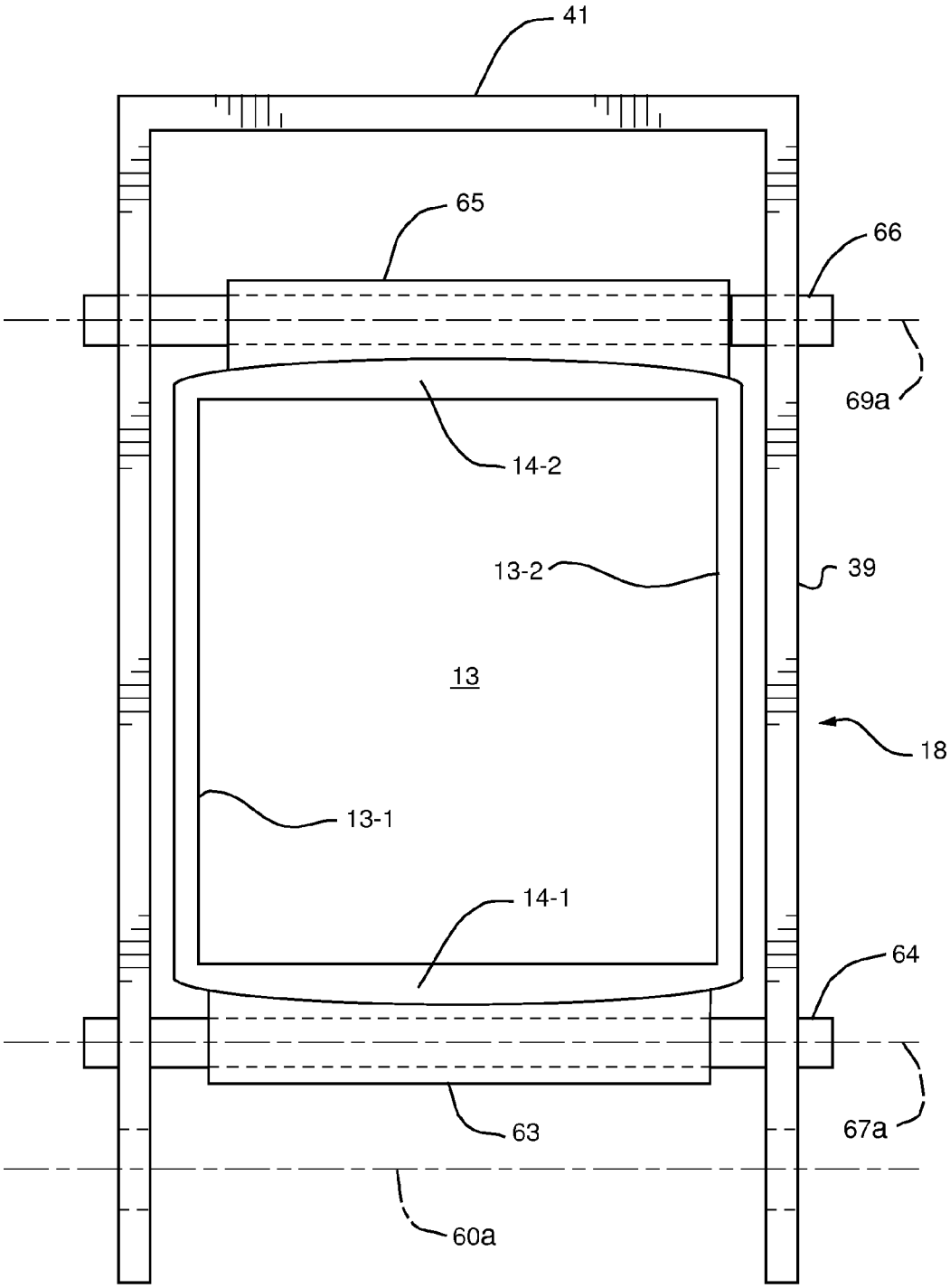
FIG. 5 is a top view of the clamp and upright of FIG. 1 the inner and outer jaws of the clamp contacting the inner and outer circular cylindrical surfaces of the upright.

FIG. 5 illustrates the important role that the inner and outer walls, 14-1 and 14-2, of tubular upright 13 in combination with the EAC jaws of inner and outer EAC jaws 63, 65 play in this invention when cross bars, 64 and 66 are mounted in side members so that said jaws 63, 65 may pivot, slide and twist independently therein as shown in FIG. 4 and described above. If cross bars 64, 66 are neither precisely parallel nor exactly coplanar, the contacting, circular, cylindrical surface of outer wall 14-2 will contact the circular, cylindrical surface of outer EAC jaw 65 over a extended area if and only if the axes of the two contacting, circular, cylindrical surfaces coincide. This is made possible by allowing the axis of the contacting, circular, cylindrical surface of outer EAC jaw 65 to slide laterally with respect to side members 39, twist about an axis perpendicular to the upright 13, and pivot about pivot axis 69*a* when clasp 18 rotates about pivot axis 60*a* into the clamped position. Then the circular, cylindrical surface of outer EAC jaw 65 will contact the circular, cylindrical surface of outer wall 14-2 on an extended area. The same situation holds for inner EAC jaw 63.

The sidewalls 13-1, 13-2 which support the inner and outer surfaces 14-1, 14-2 of upright 13 are not features of this invention. If the circular, cylindrical surfaces of the inner and outer walls were equally dimensioned and properly supported by sidewalls having the same outer circular cylindrical surfaces, the outer surface of the upright could be that of a circular cylinder.

Figure 6:
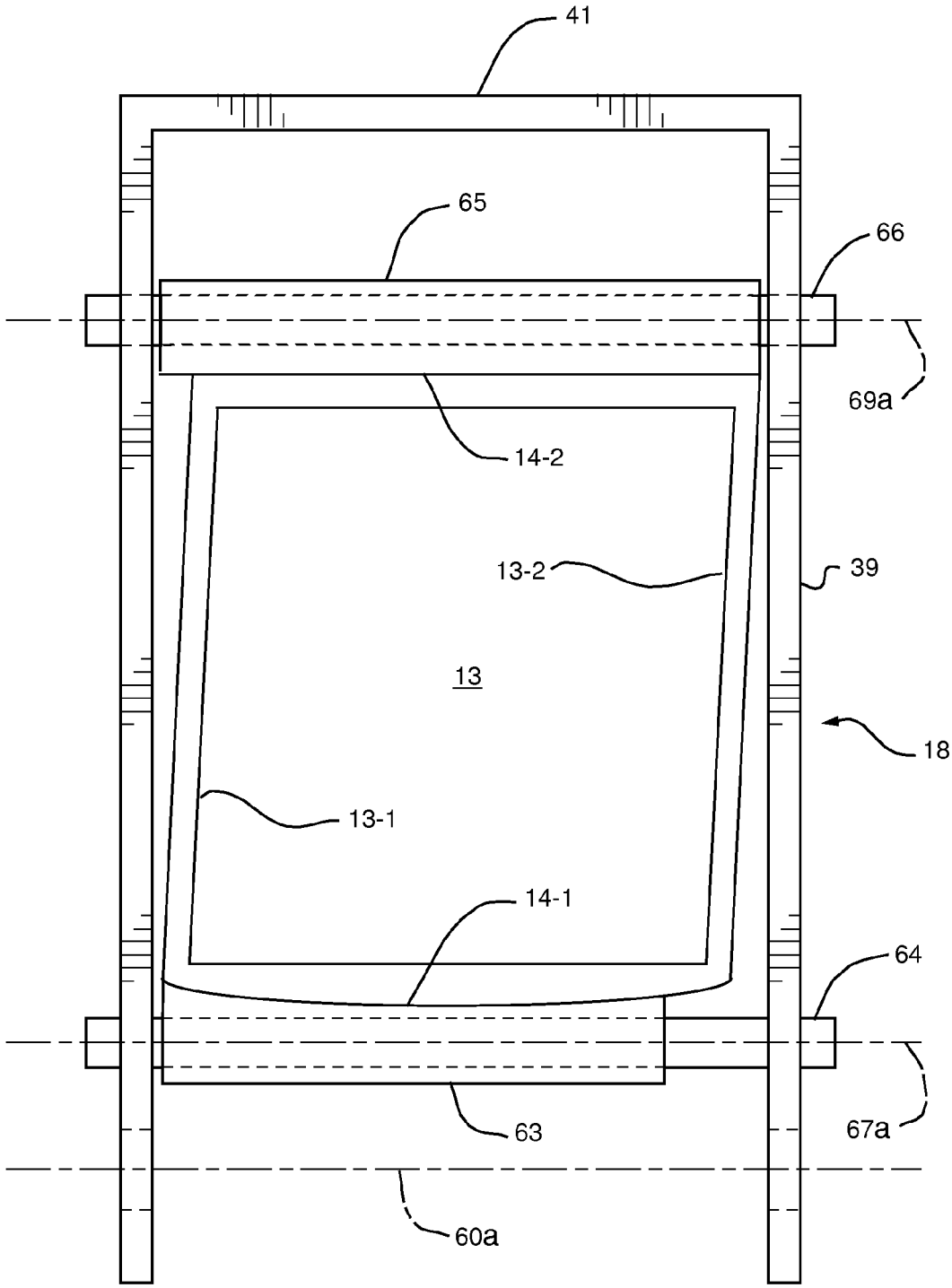
FIG. 6 is a top view of the clamp and upright of FIG. 1 showing the inner jaw of the clamp contacting the inner, circular cylindrical surface of the upright while the outer, planar jaw of the clamp contacts the outer surface of the upright on the surface of a plane.

FIG. 6 shows another misalignment, of the many possible, between upright 13 and EAC jaws 63 and 65 of clamp 18. In this case, the contacting surface of EAC jaw 65 and the contacting surface of outer wall 14-2 of upright 13 are portions of a plane whose perpendicular is not parallel to side walls 13-1 and 13-2 of upright 13. If outer EAC jaw 65 rotates about pivot axis 69*a* and rotates about an axis parallel to that of the upright 13, both independently, a horizontal force on the clamp will bring EAC jaw 65 into contact with outer wall 14-2 on the portion of a plane of extended area. In FIG. 6, it is the rotation of upright 13 with respect to clamp 39 together with the pivoting of outer EAC jaw 65 which assures that the contact between the structures will cover an extended area. Rotating the upright does not effect the extent of the area of contact of EAC jaw 63 with the inner surface 14-1 of upright 13. Its three degrees of freedom, pivoting, sliding and twisting, permit the circular, cylindrical surface of EAC jaw 63 to contact the circular, cylindrical, inner surface 14-1 of said upright 13 on an extended area when clamp 18 is clamped on the upright 13.

Figure 7:
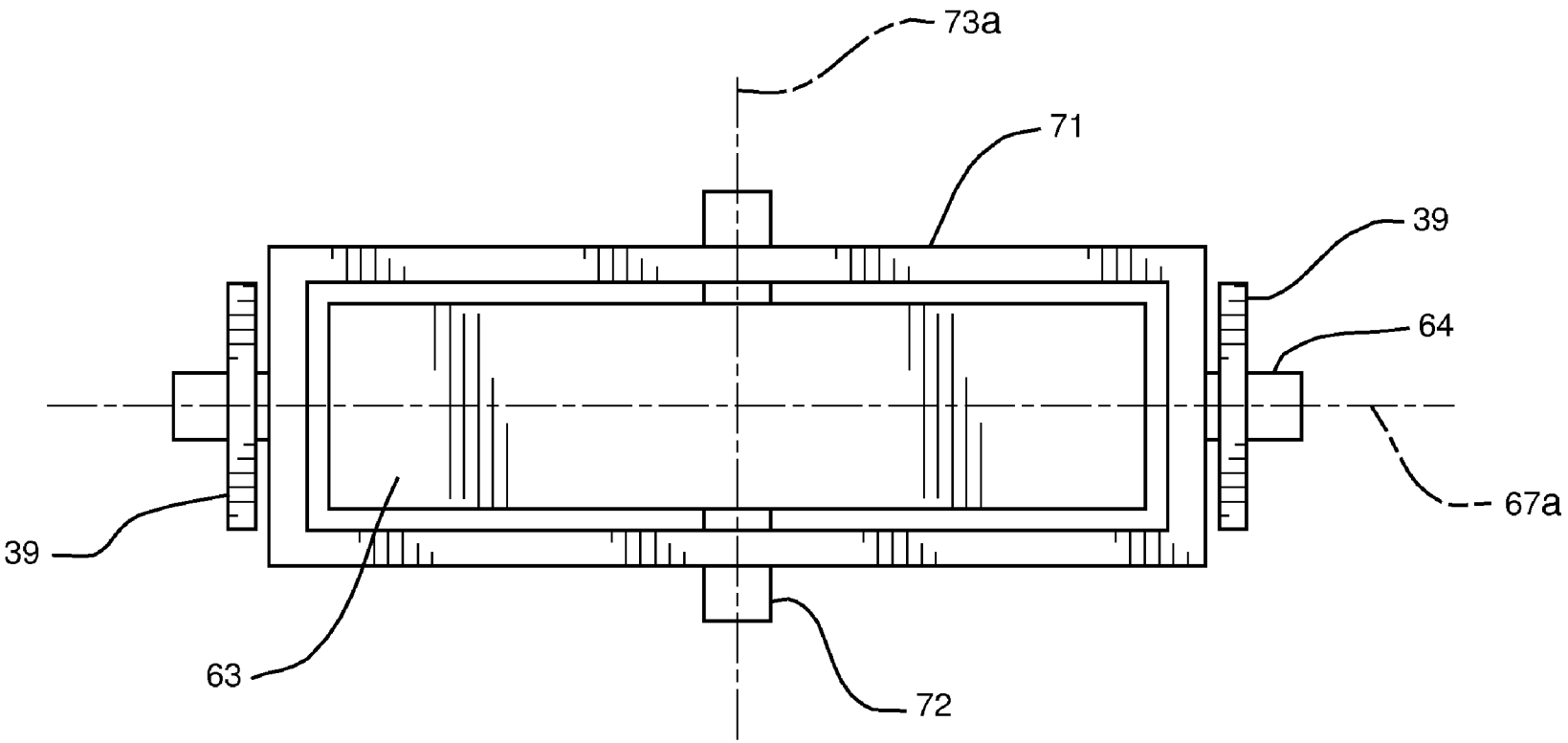
FIG. 7 is a direct view of a planar EAC jaw pivotally mounted in a frame that is pivotally mounted in the side members of the clamp.

FIG. 7 shows EAC jaw 63 mounted so as to pivot about pivot axis 73*a* in frame 71, which, in turn, is mounted so as to pivot about pivot axis 67*a* in the side members 39 of clamp 18. Since EAC jaw 63 pivots independently about vertical pivot axis 73*a* and pivots independently about horizontal pivot axis 67*a*, it will contact inner surface 14-1 of upright 13 on an extended area when clamp 18 is clamped on said upright 13 if both of the contacting surfaces are sections of planes.

Although FIGS. 1-7 and their detailed description show that EAC jaws, with either cylindrical or planar contacting surfaces, when suitably mounted in the clamp of a bracket assembly of an adjustable height scaffold will contact the matching upright on an extended area, it is not clear that the resulting friction between the jaws of the clamp and the upright will support a loaded angle bracket in the situation of greatest interest namely, steel jaws on an aluminum upright.

Figure 8:
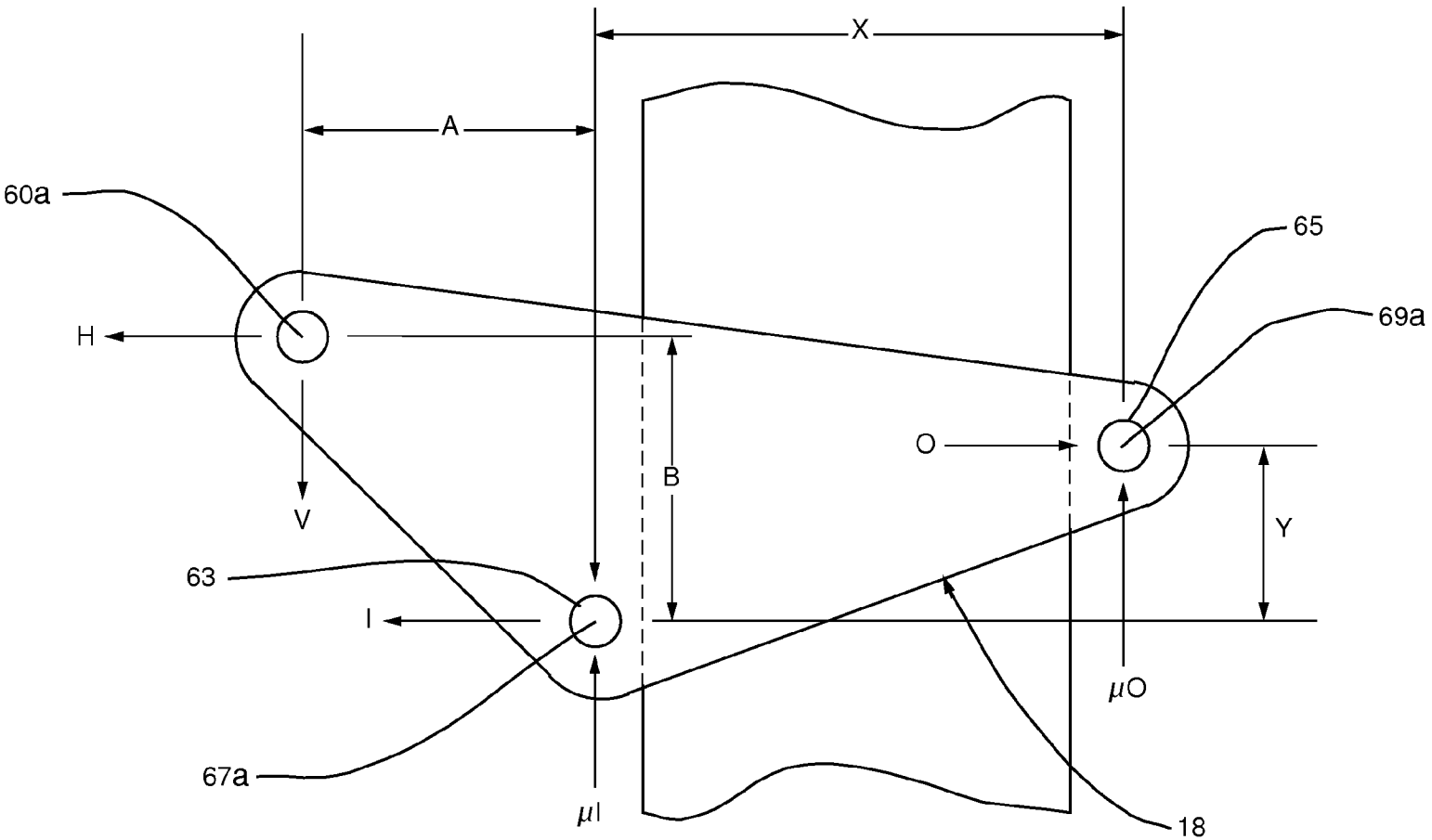
FIG. 8 is an enlarged side view of the load activated clamp shown in FIG. 2, showing the forces acting on the jaws of said clamp resulting from a vertical load placed on the angle bracket.

FIG. 8 shows a horizontal force H and a vertical force V acting on the fulcrum pivot axis 60*a* of load activated clamp 18. The inwardly directed, horizontal force applied onto inner jaw pivot axis 67*a* is denoted by arrow I, and the upwardly directed, frictional force applied onto inner jaw pivot axis 67*a* is denoted by arrow μI. The outwardly directed, horizontal force applied onto outer jaw pivot axis 69*a* is denoted by arrow, O and the upwardly directed frictional force applied onto outer jaw pivot axis 69*a* is denoted by μO, wherein μ represents the minimum coefficient of friction between jaws 63 and 65 and upright 13 which will prevent slipping of clamp

18. Distances, A and B represent the horizontal and vertical distances, respectively, between fulcrum pivot axis 60*a* and inner jaw pivot axis 67*a*. Distances X and Y represent the horizontal and vertical distances, respectively, between the outer jaw pivot axis 69*a* and the inner jaw—pivot axis 67*a*.

Accordingly, the horizontal forces represented by arrows I and 0 and the minimum value of μ can be found from the following equations, given the values of H, V:

$O=I+H$ because the horizontal forces add to zero, Equation 1 and $V=\mu\times(O+I)$ because the vertical forces add to zero. Equation 2

$\mu=V/(O+I)=(O\times Y-V\times A-H\times B)/(O\times X)$ because the moment about the pivot axis 67*a* is zero. Equation 3 or $V\times 0\times X=(2\times 0-H)^{x}(0\times Y-V\times A-H\times B)$ Equation 4

Given the values of V, H, A, B, X and Y, the value of 0 can be found from quadratic equation (4). The value of I can be determined from (1) and then p, the minimum value of the coefficient of friction which will prevent slipping, can be found from (2).

In an experimental model, built to confirm these calculations, X=4.0", Y=1.15", A=1.65" and B=1.15". For V=1001b and H=501b, it was found by these equations that 0=379.651b, I=329.651b and μ=0.141. As can be appreciated, a bracket assembly with a load activated clamp having stainless steel, EAC jaws can be used on aluminum uprights with a safety factor of 2, since the coefficient of friction of stainless steel on aluminum has value approximating 0.3. The need for the EAC jaws to minimize the damage to an aluminum upright is clear from the fact that a 5001*b* vertical load placed on the horizontal leg of the bracket assembly at a location so that H=2501b will result in an inward force onto the outer wall, of the upright which approximates one ton. As can be appreciated, subjected to these large forces, the edged jaws of prior art locks will significantly damage an aluminum or plastic upright.

A model built to these dimensions supported the load even when the aluminum upright was greased. Of course, the safety factor can be increased by lining the inner surface of the EAC jaws with material having a high coefficient of friction: brake lining for example.

By using EAC jaws, mounted in the side members with sufficient freedom of motion, instead of edged jaws, the horizontal forces, which the jaws exert on the upright, can be distributed over a sufficiently large area so that the upright suffers minimum damage from a loaded angle bracket.

Although a primary application for the use of EAC jaws, in the clamps of bracket assemblies depends on friction between the jaws of the clamps and the uprights to support the load, the same clamp will support a load, with little or no friction, if the distance between the inner and outer surfaces of the upright diminishes with height.

Although the clamp must pivot with respect to the angle bracket and each EAC jaw must pivot with respect to the at least one side member if the load supporting bracket assembly is to be adjusted, in height on an upright, safely, it may not be needed that the contacting surface of an EAC jaw have a circular cross section and be slidably and twistably mounted on said side member if the parts involved are fabricated with sufficient accuracy. The accuracy required will be less if the contacting material of an EAC jaw is pliable, brake lining, for example.

As mentioned above, the present invention is not intended to be limited to a system or method which must satisfy one or more of any stated or implied object or feature of the invention and should not be limited to the preferred, exemplary, or primary embodiment(s) described herein. The foregoing description of preferred embodiments of the invention has been presented for purposes of illustration and description. It is not intended to be exhaustive or to limit the invention to the precise forms disclosed. Obvious modifications or variations are possible in light of the above teachings. The embodiment were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with the breadth to which they are fairly, legally and equitably entitled and their legal equivalents.

The invention claimed is:

1. A clamp for mounting an angle bracket on an upright, said clamp comprising:

a pair of side members;

an outer jaw and inner jaw coupled to said pair of side members by separate pivoting means; and pivoting means which is configured to couple said pair of side members to said angle bracket, said pair of side members being capable of pivoting relative to said angle bracket using said pivoting means, at least one of said inner jaw and said outer jaw comprising a circular, cylindrical contact surface, said cylindrical contact surface configured to contact a circular, cylindrical contact surface of the upright over an extended area, said at least one of said inner jaw and said outer jaw being capable of pivoting relative to said pair of side members and said angle bracket, wherein at least one of said outer jaw and said inner jaw can pivot and move transversely about a pivot axis.

2. The clamp as claimed in claim 1 wherein said pivoting means coupling said clamp to said angle bracket and said pivoting means coupling said inner and outer jaws to said side members are positioned so that said clamp is load activated.

3. The clamp as claimed in claim 1 wherein said pivoting means, coupling said angle bracket to said pair of side members, is a fulcrum bar which determines said pivot axis about which said side members pivot with respect to said angle bracket.

4. The clamp as claimed in claim 1 wherein said at least one of said inner jaw and said outer jaw pivots relative to said pair of side members and said angle bracket about a pivot axis fixed in said side members.

5. The clamp as claimed in claim 3 wherein said at least one of said inner jaw and said outer jaws pivots relative to said pair of side members and said angle bracket about pivot axis fixed in said side members.

6. The clamp as claimed in claim 3 wherein said inner jaw and said outer jaw pivot relative to said pair of side members and said angle bracket about a separate pivot axis each fixed in said side members.

7. The clamp as claimed in claim 6 wherein said inner jaw pivot axis lies below the plane defined by said outer jaw pivot axis and said fulcrum bar axis.

8. A bracket kit comprising:

an upright, said upright having at least a first contact surface having at least a first substantially cylindrical outer surface whose axis parallels the longitudinal axis of said upright; and a bracket assembly including:

an angle bracket;

a lower bracket arm configured to be secured to said angle bracket, said lower bracket arm sized and shaped to mate with said at least a first substantially cylindrical outer surface of said upright; and a clamp with first and second generally parallel side members;

an outer jaw and inner jaw each coupled independently to said first and second side members, wherein at least one of said outer and said inner jaws is coupled to said first and said second side members such that said at least one of said inner jaw and said outer jaw pivots in said first and second side members, said at least one of said outer and inner jaws sized and shaped so that when it is pivotally mounted on said first and second side members it has sufficient degrees of freedom to contact said at least first substantially cylindrical outer surface of said upright over an extended area when said clamp is locked on said upright.

9. The bracket kit as claimed in claim 8 wherein both said inner and said outer jaws include a substantially semi-cylindrical outer surface running along said longitudinal axis of said contact surfaces.

10. The bracket kit as claimed in claim 8 wherein said upright further includes at least a second contact surface having at least a second substantially semi-cylindrical outer surface running along said longitudinal axis of said upright.

11. A clamp for use with mounting an angle bracket on an upright having an outer radius on at least one exterior surface, said clamp comprising:

a frame including means for pivoting; and a first jaw coupled to said frame, wherein said first jaw is secured to said frame such that said first jaw can pivot and move transversely about a pivot axis; and a first contact surface having a substantially semi-cylindrical cross-section with an inner radius which is configured to substantially contact said at least one exterior surface of said upright having a corresponding outer radius.

12. The clamp as claimed in claim 11 further including a second jaw coupled to said frame.

13. The clamp as claimed in claim 12 wherein a longitudinal cross-sectional area of said second jaw is generally rectangular in shape.

14. The clamp as claimed in claim 13 wherein said first jaw is pivotally mounted on a bar coupled to said frame.

15. The clamp as claimed in claim 12 wherein both said first and second jaws include a substantially semi-cylindrical outer surface running along said longitudinal axis of said contact surfaces.

16. The clamp as claimed in claim 12 wherein said frame further includes at least one side member and an angle bracket and wherein said means for pivoting further includes a fulcrum bar coupling said at least one side member and said angle bracket such that said at least one side member is adapted to pivot relative to said angle bracket about said fulcrum bar.

17. The clamp as claimed in claim 16 wherein a pivot axis of said first jaw, said second jaw, and said fulcrum bar are substantially co-planar.

18. The clamp as claimed in claim 16 wherein a pivot axis of said second jaw lies below a substantially horizontal plane passing through a pivot axis of said fulcrum bar.

19. A clamp for use with mounting an angle bracket on an upright having an outer radius on at least one exterior surface, said clamp comprising:

a frame including a fulcrum bar, said fulcrum bar configured for providing means for pivoting said frame to said angle bracket;

a first jaw coupled to said frame and including a first contact surface having a substantially semi-cylindrical cross-section with an inner radius which is configured to substantially completely contact said at least one exterior surface of said upright having a corresponding outer radius, wherein said first jaw can pivot and move transversely about a pivot access;

said clamp further including a second jaw pivotally coupled to said frame, wherein a pivot axis of said second jaw lies below a substantially horizontal plane passing through a pivot axis of said fulcrum bar.

* * * * *